United States Patent [19]

Peterson et al.

[11] Patent Number: 4,668,017

[45] Date of Patent: May 26, 1987

[54] STRIPPING MACHINE

[76] Inventors: Clayton R. Peterson, 308 Avenita Santa Margarita, San Clemente, Calif. 92672; James E. Ward, 2023 Exmoor Pl., Glendora, Calif. 91740

[21] Appl. No.: 628,235

[22] Filed: Jul. 6, 1984

[51] Int. Cl.[4] ..... E21C 25/00

[52] U.S. Cl. ..... 299/37; 299/41; 299/34; 299/89

[58] Field of Search ..... 299/39, 34, 36, 37, 299/24, 41, 9 L, 89, 88, 91; 172/51

[56] References Cited

U.S. PATENT DOCUMENTS

| | | | |
|---|---|---|---|
| 3,347,596 | 3/1965 | Brejcha et al. | 299/41 X |
| 3,472,555 | 10/1969 | Theefmann et al. | 299/41 |
| 3,701,221 | 10/1972 | Vinella | 299/41 X |
| 3,775,018 | 11/1973 | Barton | 299/36 X |
| 4,068,897 | 1/1978 | Amoroso | 299/89 X |
| 4,155,596 | 5/1979 | Brejcha | 299/41 X |
| 4,273,384 | 6/1981 | Freeburn | 299/41 |
| 4,295,274 | 10/1981 | Bricher et al. | 299/41 X |

*Primary Examiner*—Stephen J. Novosad

*Assistant Examiner*—Thomas J. Odar

*Attorney, Agent, or Firm*—Lyon & Lyon

[57] ABSTRACT

There is disclosed herein a machine for removing coatings from uneven surfaces such as concrete and the like. The machine includes a power system for driving a pair of cutter head assemblies. The cutter head assemblies are rotated in opposite directions to help stabilize the machine and to throw the cuttings out of the way. Each cutter head assembly has a cutter head with a plurality of peripheral sides or facets and cutter bars are spring loaded thereon to allow cutting tools held by the cutter bars to effectively float on the concrete surface and follow uneven sections of the surface. The cutter head assemblies are mounted on the machine so that they can tilt forward and backward and from side to side to facilitate the cutter head assemblies following uneven surfaces. In one embodiment a plurality of cutter bars are pivotally mounted to the peripheral faces of each cutter head, and in another embodiment cutter pads with diamond bits are spring loaded and extend from the bottom surface of the cutter head.

8 Claims, 11 Drawing Figures

STRIPPING MACHINE

SUMMARY AND BACKGROUND

The present invention relates to cutting machines, and more particularly to a stripping machine employing cutting heads for removing coatings from uneven concrete surfaces.

Various techniques and forms of machines and devices have been developed for removing coatings from concrete surfaces and the like. Examples of such coatings are urethane and elastomeric coatings for parking decks and the like, vinyl type floor coverings, and mastics and other types of adhesives used to glue down carpet and other floor coverings. Among the techniques and devices for removing such coatings are simple scraping tools, heat or chemical removing devices or techniques, and sanding or grinding machines which cut or grind away the coating. One particular problem encountered in removing coatings from concrete surfaces is the fact that such surfaces inherently are not absolutely flat, and cutting or grinding devices cut too much off of high spots and remove too little from low spots.

A stripping machine according to the present invention includes a machine which drives a pair of cutter head assemblies each having a cutter head and a plurality of spring biased cutters or bits which can move up and down to follow uneven surfaces. The cutter head assemblies are mounted on the machine so that these assemblies also can pivot and tilt. Two cutter heads preferably are employed with each cutter head having a plurality of peripheral faces or facets, such as eight, so that the two heads can be arranged together and rotated to provide an overlapping cutting pattern. In this manner, the stability of the stripping machine is improved without requiring the use of three or more heads to achieve the overlapping cutting pattern and appropriate machine stability.

Accordingly, it is the principal object of the present invention to provide an improved form of cutting machine.

Another object of this invention is to provide a stripping machine employing cutter heads having a plurality of peripheral faces for allowing two or more cutter heads to be disposed in an adjacent manner for providing overlapping cutting patterns.

Another object of this invention is to provide a stripping machine employing a pair of multifaceted cutting heads, each having a plurality of spring biased cutters for facilitating stripping material from uneven surfaces.

These and other objects and features of the present invention will become better understood through a consideration of the following description taken in conjunction with the drawings in which.

Figure 3:
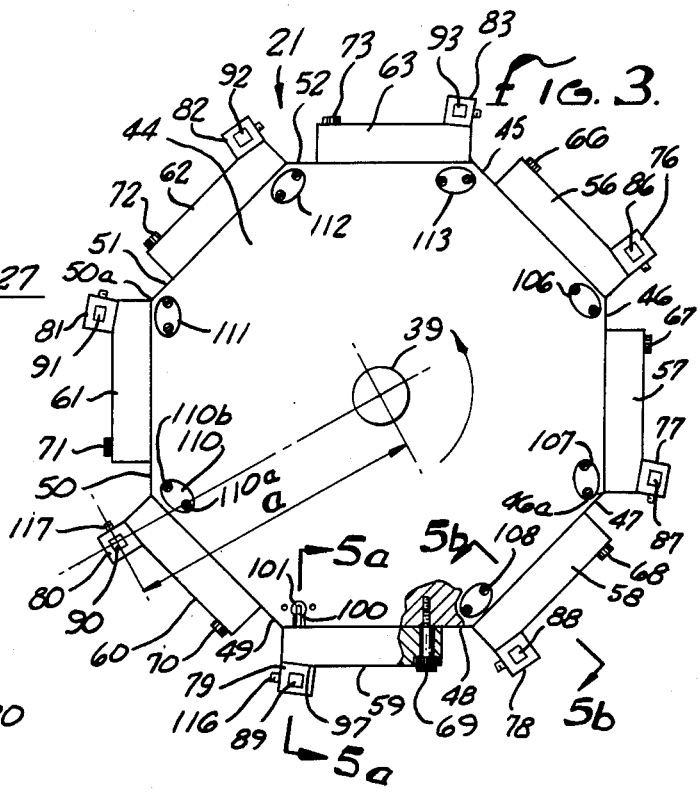
FIG. 3 is a top plan view of a cutter head assembly of the machine.
Figure 5A:
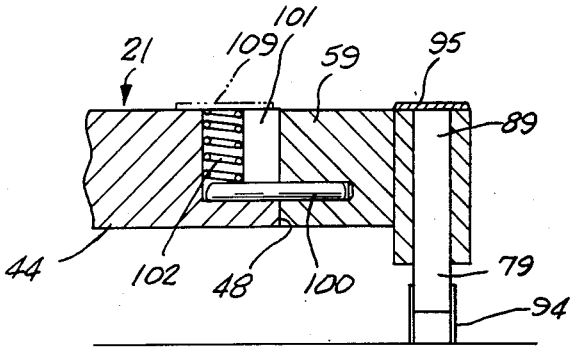
Figure 6:
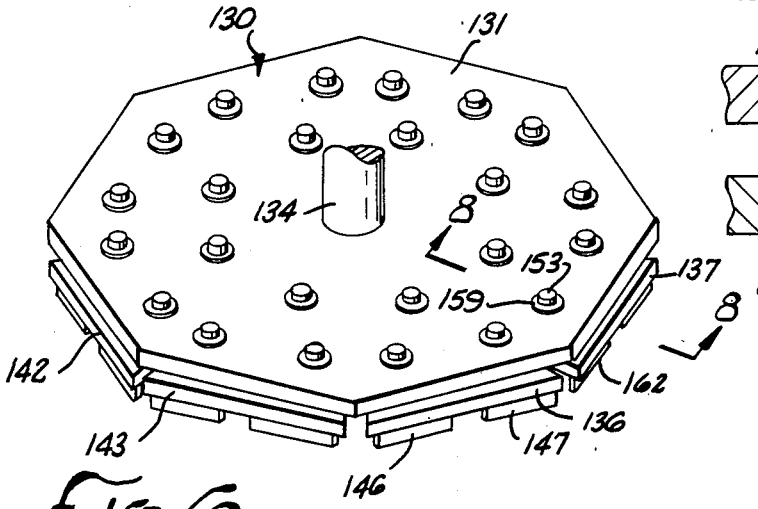
Figure 8:
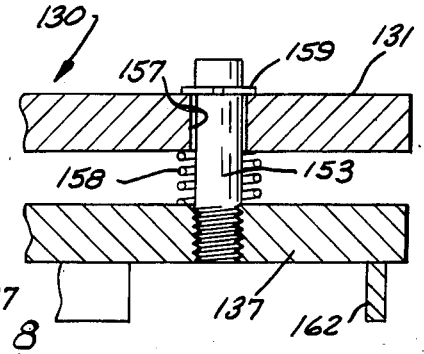
Figure 5B:
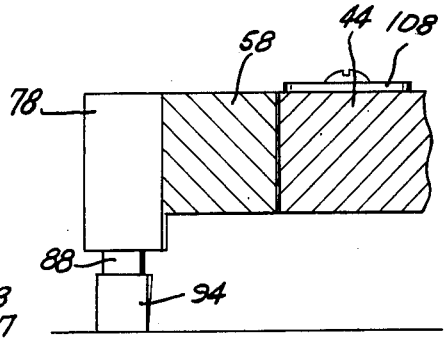
Figure 7:
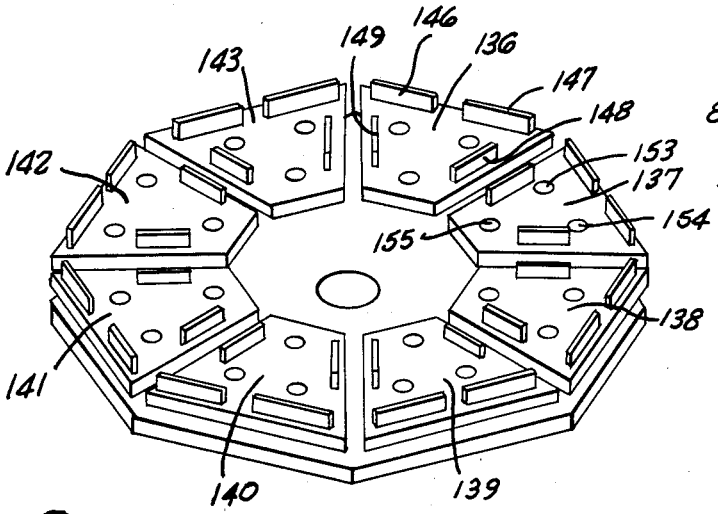
Figure 10:
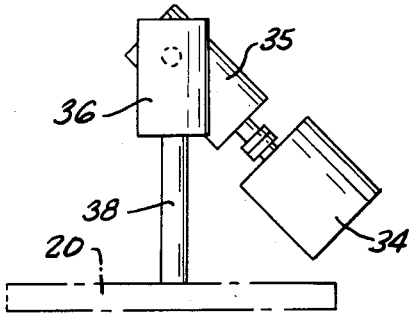
Figure 9:
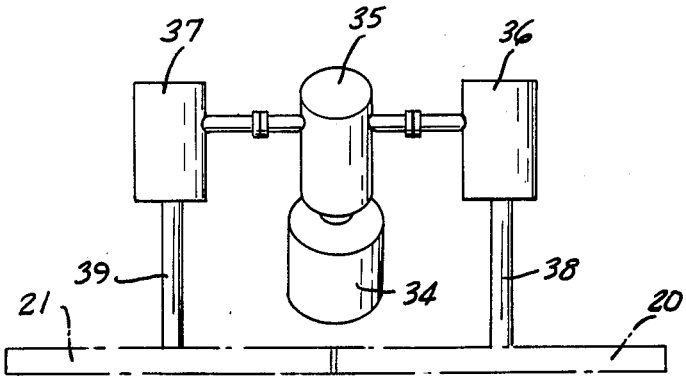

FIGS. 5*a* and 5*b* are cross-sectional views taken along lines 5*a*—5*a* and 5*b*—5*b* of FIG. 3;

FIG. 6 is a top perspective view of an alternative form of cutter head assembly using diamond bits;

FIG. 7 is a bottom perspective view of the cutter head assembly of FIG. 6;

FIG. 8 is a cross-sectional view taken along line 8—8 of FIG. 6; and FIGS. 9 and 10 are diagrammatic views illustrating a hydraulic motor and gear drive assembly for driving the cutter head assemblies of the present invention.

DETAILED DESCRIPTION

Figure 1:
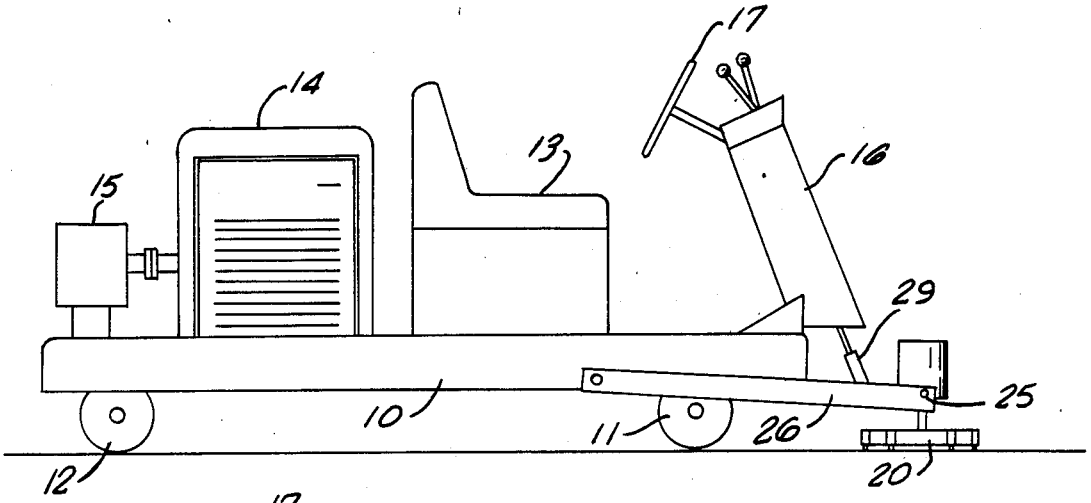
FIG. 1 is a side elevational view of a stripping machine according to the present invention.
Figure 2:
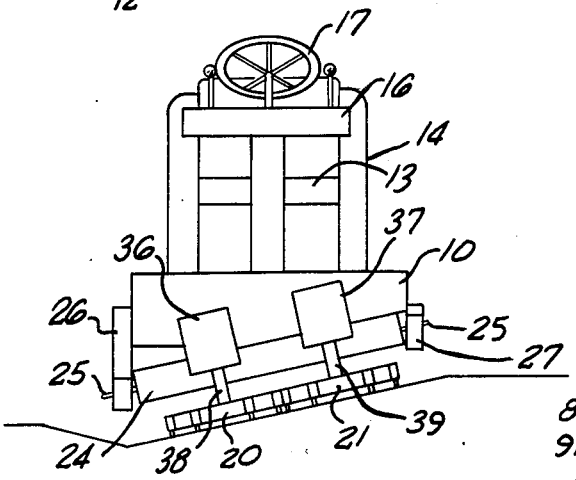
FIG. 2 is a front elevational view thereof.

Turning now to the drawings, and first to FIGS. 1 and 2, a stripping machine according to the present invention is shown generally comprising a base or body 10 mounted on a plurality of wheels 11–12, and which includes a driver's seat 13, power source 14, hydraulic pump 15, control console 16 and steering wheel 17. More particularly, the stripping machine comprises a pair of cutter head assemblies 20 and 21 suitably mounted on a support arm 24 to allow these assemblies 20–21 to pivot about pivots 25 in a backward and forward direction, and mounted on a pair of control arms 26–27 to allow the cutter head assemblies 20–21 to tilt from side to side as seen in FIG. 2 and to be raised up and down under control of a hydraulic cylinder 29. The hydraulic cylinder also is used to supply downward pressure to the cutter assemblies 20–21.

The drive system for the cutter head assemblies 20–21 is only diagrammatically illustrated in FIGS. 1–2, but is shown in greater detail in FIGS. 9–10. In an exemplary embodiment, a hydraulic motor 34 is provided which is connected through a "tee" gear box 35 to a pair of right angle gear boxes 36–37 and to respective drive shafts 38–39 which rotate the cutter head assemblies 20–21. The power source 14 in a typical stripping machine as seen in FIGS. 1–2 may comprise a thirty horsepower engine for driving the hydraulic pump. Smaller and larger machines can be built using smaller or larger power sources. For example, a portable hand controlled stripping machine can use a relatively small gasoline engine or electric motor for driving the hydraulic pump.

Turning now to a more detailed description of the cutter head assemblies, both of the assemblies 20 and 21 are identical, and only the cutter head assembly 21 is shown in detail in FIGS. 3 and 5. The cutter head assembly 21 comprises a cutter head 44 having a plurality of peripheral faces or facets, such as eight, 45 through 52. Cutter bars 56–63 are pivotally mounted on the respective faces 45–52 by means of pivot bolts 66–73. The cutter bars 56–63 have affixed thereto respective tool holders 76–83 which carry respective cutter tools 86 through 93, and the cutter tools preferably each include a carbide insert, with carbide insert 94 being seen in detail in FIG. 5*b*.

Each of the cutter bars 56–63 is spring biased in a downward direction by means of a suitable spring assembly, one of which is shown in detail in FIG. 5*a*. This spring assembly comprises a cutter bar pin 100 disposed in an opening toward the trailing end of the cutter bar 59, and the inner end of the pin 100 extends into a slot 101 which opens out to the face 48. A spring 102 is disposed in the slot 101 and is retained in place by a spring plate 109 (note the spring plates 106–108 and 110–113 in FIG. 3 as well as the plate 109 in FIG. 5). These spring plates are retained on the upper surface of the cutter head 44 by suitable screws (note screws 110*a* and 110*b* in FIG. 3), and these screws can be tightened or loosened to provide a tension adjustment for the cutter bars.

Each of the cutter tools is retained in the tool holder by a suitable set screw (note, for example, set screws 116 and 117 in the tool holders 79–80 in FIG. 3). A cover 95 (see FIG. 5*a*) can be provided at the top of each tool holder to help retain the cutter tool if desired. The cutter tools are readily removable for replacement as needed.

The structure of the cutter head assemblies allows the cutter bars 56–63 to pivot up and down about the pivot bolts 66–73 under spring pressure so as to allow the cutter tools to "float" and follow the uneven contour of a concrete surface. The articulated support arm 24 and control arms 26–27 allow the cutter tool assemblies 20–21 to follow gross or major unevenesses of the concrete surface, and the pivoted cutter bars allow the cutter tools to follow the small or minor unevenesses in the concrete surface.

Figure 4:
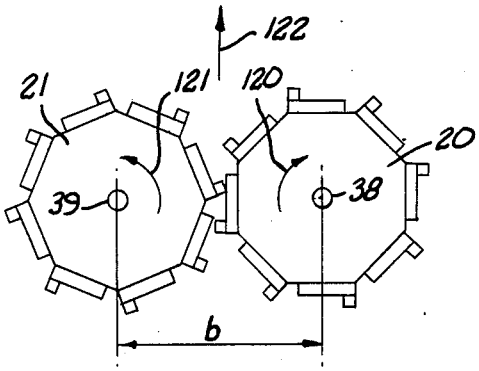
FIG. 4 is a diagram illustrating the manner in which a pair of cutter head assemblies are disposed and rotated to provide an overlapping cutting pattern.

FIG. 4 shows the counter or opposite rotation pattern of the cutter head assemblies 20–21, and they rotate preferably in the directions indicated by arrows 120–121 which facilitates throwing the cuttings and debris out of the way as the machine of FIGS. 1–2 moves forward in the direction indicated by the arrow 122 in FIG. 4. The spacing of the drive shafts 38 and 39 of the cutter head assemblies 20 and 21, as indicated by the space "b" in FIG. 4, is chosen to allow the cutter tools to slightly overlap (such as one half inch) as the cutter head assemblies 20 and 21 rotate, but is sufficiently long to prevent the tool holders and cutter bars from touching or hitting each other. This overlap of the cutting patterns is made possible by the use of the multiple faces, preferably eight, 45–52, and this arrangement allows two cutter head assemblies 20–21 to be used on the machine, whereas, three such assemblies would be required to get overlapping cuts if no such overlapping pattern were provided. It will be noted that the tool holders 76–83 are mounted at a slight angle (note 97 in FIG. 30) with the cutting edge on a radial line so as to provide an appropriate circular cut.

As an example of size of the cutter head, the same may be sixteen inches from corner to corner (e.g., from corner 46*a* to corner 50*a*) the cutter bars may be approximately five inches long, and the width of these bars and the tool holders may be approximately one inch. The cutter head assemblies 20 and 21 are rotated at an appropriate speed depending upon the material to be stripped and the forward speed of the stripping machine.

Turning now to the embodiment of FIGS. 6–8, one cutter head assembly 130 is shown which also comprises a multiface (e.g., eight) cutter head 131. Instead of the pivoted cutter bars of the embodiment of FIG. 3, the cutter head assembly 130 comprises a plurality of spring biased cutter pads 136–143 on which are mounted a plurality of diamond bits. For example, the cutter pad 136 has four diamond bits 146–149 suitably affixed to the pad and extending downwardly. The cutter head 131 is mounted onto and driven by a drive shaft 134.

Each of the cutter pads 136–143 is secured to a plurality of mounting pins, such as pins 153 through 155 secured to the pad 137. FIG. 8 is a cross-sectional view which shows the details of the mounting of one pin 153 to the pad 137. The lower end of the pin 153 is threaded into the pad 137, and the upper end of the pin 153 extends upwardly through an opening 157 in the cutter head 131. A coil spring 158 is disposed between the pad 137 and the bottom surface of the cutter head 131, and the assembly of the pad 137, pin 153 and spring 158 is retained onto the cutter head 131 by a clip ring 159 clipped onto the top of the pin 153 as best seen in FIGS. 8 and 6. This arrangement allows the cutter pads 136–143 to move up and down against the force of the associated springs so as to allow the cutter head assembly 130 to follow the uneven surface being stripped. As is the case with the arrangement of FIGS. 1–3, two of the cutter head assemblies 130 of FIGS. 6–8 are mounted on shafts and driven in the same manner described in connection with the previous embodiment. Either embodiment can be used also to break the surface of concrete for better adhesion of various coatings.

While presently preferred embodiments of the present invention have been illustrated and described, modifications and variations thereof will be apparent to those skilled in the art given the teachings herein, and it is intended that all such modifications and variations be encompassed within the scope of the appended claims.

What is claimed is:

1. In a stripping machine for removing coatings from uneven concrete surfaces and the like and wherein the stripping machine includes a body for supporting a plurality of cutter head assemblies and means for supplying motive power to the assemblies, the improvement comprising a plurality of counter-rotating cutter head assemblies disposed for rotation to provide overlapping cutting patterns and wherein each of the cutter head assemblies comprises a plurality of cutter bit means, cutter head means for supporting said cutter bit means, spring biasing means disposed between said cutter bit means and said cutter head means for biasing said cutter bit means in a direction to engage the surface being stripped, and said cutter head means including a cutter head having a plurality of peripheral faces with said cutter bit means mounted adjacent respective faces so that a pair of cutter head assemblies can be disposed adjacent each other to enable the cutter bit means of each assembly to provide a cutting pattern overlapping with the cutting pattern of the other assembly and without the cutter head means or cutter bit means of one assembly engaging the cutter head means or cutter bit means of the other assembly, said cutter bit means comprising a cutter bar pivotally mounted on each of said faces on axes substantially orthogonal to said faces, each of said cutter bars including a tool holder affixed thereto on a radially disposed outer surface of the cutter bar for receiving and retaining a cutter tool.

2. A stripping machine for removing coatings from uneven concrete surfaces and the like including a movable body, a pair of cutter head assemblies, cutter head assembly support means comprising a support bar and a pair of control arms pivotally mounted to the body of said machine to allow said cutter head assemblies to pivot together in backward and forward and sideways directions, said cutter head assemblies comprising a pair of counter-rotating cutter head assemblies, with each said assembly comprising a cutter head having peripheral outer faces, and said assemblies being mounted adjacent each other on said support means, a plurality of cutter bars pivotally mounted to the respective faces of the cutter head, and each of said cutter bars including a cutter bit holder for holding a cutter bit radially outward from the respective face and cutter bar, spring biasing means disposed between said cutter bars and said cutter head for biasing said cutter bit holders in a direction to engage the surface to be stripped, and said cutter head assemblies being disposed adjacent each other to enable cutter bits disposed in the cutter bit holders of each assembly to provide a cutting pattern overlapping with the cutting pattern of the other assembly and without the cutter head or cutter bit holder of one assembly engaging the cutter head or cutter bit holder of the other assembly.

3. In a stripping machine for removing coatings from uneven concrete surfaces and the like, and wherein the stripping machine includes a body for supporting a plurality of cutter head assemblies and means for supplying motive power to the assemblies, the improvement comprising a plurality of cutter head assemblies disposed for roation to provide adjacent cutting patterns and wherein each of the cutter head assemblies comprises a plurality of cutter bit means, each said cutter bit means including a tool holder for holding cutter tool means, with each cutter tool means having a cutting face, cutter head means for supporting said cutter bit means, said cutter head means having an axis of rotation and a plurality of peripheral outer faces, spring biasing means disposed between the cutter tool holders and the cutter head means for biasing said cutter tool means in a direction to engage the cutting faces of the cutter tool means with the surface being stripped, and said tool holders having one end pivotally mounted on axes substantially orthogonal to respective peripheral outer faces of the cutter head means and with the cutter tool means being mounted near the other end of the respective tool holders to cause the cutter tool means to ride near the trailing edges of the respective peripheral faces of the cutter head means for maintaining the cutting faces of the cutter tool means substantially parallel to the radius of the cutter head means so as to facilitate maintaining substantially the entire cutting faces of the cutter tool means in contact with the surface being cut as the tool holders pivot with respect to the cutter head means.

4. A cutter head assembly as in claim 3 wherein the cutting faces of the cutter tool means are disposed at a small angle with respect to the radius of the cutter head means to cause the head assembly to provide a circular cut as the cutter head means rotates, and said cutter head assemblies comprise two head assemblies wherein the axis of rotation of the respective cutter head means thereof are spaced to allow an overlapping cutting pattern provided by the cutting faces of the cutter tool means of the respective cutter head assemblies.

5. A stripping machine as in claim 4 wherein the stripping machine comprises a cutter head assembly support comprising a support bar and a pair of control arms pivotally mounted to the body of said machine to allow said cutter head assemblies to pivot together in a backward and forward and sideways direction, and said cutter head assemblies being driven in counter-rotating directions, with each said assembly comprising a cutter head having eight tool holders.

6. In a stripping machine for removing coatings from uneven concrete surfaces and the like, and wherein the stripping machine includes a body for supporting a plurality of cutter head assemblies and means for supplying motive power to the assemblies, the improvement comprising a plurality of counter-rotating cutter head assemblies disposed for rotation to provide overlapping cutting patterns and wherein each of the cutter head assemblies comprises cutter head means for rotation about an axis and for supporting cutter bit means, a plurality of cutter bit means comprising a plurality of cutting pads mounted radially adjacent each other around the underside and toward the periphery of the cutter head means, each of said cutting pads being resiliently mounted on the underside of the cutter head means, and each cutter pad having affixed thereto a plurality of cutter bits with at least some of said cutter bits arranged in a radial direction and at least some of said cutter bits arranged tangentially at an edge of the pad and disposed at the periphery of the cutter head means so that a pair of cutter head assemblies can be disposed adjacent each other to enable the cutter bit means of each assembly to provide a cutting pattern overlapping with the cutting pattern of the other assembly and without the cutter head means or cutter bit means of one assembly engaging the cutter head means or cutter bit means of the other assembly.

7. A stripping machine according to claim 6, further comprising:

cutter head assembly support means comprising a support bar and a pair of control arms pivotally mounted to the body of said machine to allow said cutter head assemblies to pivot together in backward and forward and sideways directions.

8. In a stripping machine for removing coatings from uneven concrete surfaces and the like and wherein the stripping machine includes a body for supporting a plurality of cutter head assemblies and means for supplying motive power to the assemblies, the improvement comprising a plurality of counter-rotating cutter head assemblies disposed for rotation to provide overlapping cutting patterns and wherein each of the cutter head assemblies comprises a plurality of cutter bit means, cutter head means for supporting said cutter bit means, spring biasing means disposed between said cutter bit means and said cutter head means for biasing said cutter bit means in a direction to engage the surface being stripped, and said cutter head means including a cutter head having a plurality of peripheral faces with said cutter bit means mounted adjacent respective faces so that a pair of cutter head assemblies can be disposed adjacent each other to enable the cutter bit means of each assembly to provide a cutting pattern overlapping with the cutting pattern of the other assembly and without the cutter head means or cutter bit means of one assembly engaging the cutter head means or cutter bit means of the other assembly, said cutter bit means comprising a cutter bar pivotally mounted on each of said faces on axes substantially orthogonal to said faces, each of said cutter bars including a cutter tool affixed thereto and radially extending past the outer surface of the cutter bar.

* * * * *